United States Patent [19]

Ebert

[11] Patent Number: 4,877,077

[45] Date of Patent: Oct. 31, 1989

[54] VERTICAL COEXTRUDED PEARLESCENT LOUVER FOR VERTICAL BLINDS

[75] Inventor: George W. Ebert, Chatsworth, Calif.

[73] Assignee: Home Fashions, Inc., Santa Monica, Calif.

[21] Appl. No.: 193,806

[22] Filed: May 13, 1988

[51] Int. Cl.[4] ..... E06B 3/04

[52] U.S. Cl. ..... 160/236; 428/324

[58] Field of Search ..... 160/236; 428/324

[56] References Cited

U.S. PATENT DOCUMENTS

| | | | |
|---|---|---|---|
| 2,555,224 | 5/1951 | Decker | 106/287 |
| 2,851,370 | 9/1958 | Blank | 106/193 |
| 3,379,674 | 4/1968 | Jakob et al. | 260/41 |
| 3,645,317 | 2/1972 | Malone | 160/168 |
| 4,049,038 | 9/1977 | Hyman et al. | 160/166 |
| 4,416,940 | 11/1983 | Loye et al. | 428/324 |
| 4,551,491 | 11/1985 | Panush | 524/31 |

*Primary Examiner*—Blair M. Johnson

*Attorney, Agent, or Firm*—Welsh & Katz, Ltd.

[57] ABSTRACT

A multilayer coextruded slat having upper and lower surfaces has an opaque base layer containing a first thermoplastic polymer, and a thin transparent pearlescent layer containing a a second thermoplastic polymer upon at least one surface of the opaque base layer. In an alternate embodiment a center layer is confined between the opaque base layer and the clear transparent pearlescent surface layer to provide a pearlescent color effect. Such multilayer coextruded slats may be utilized as the louvers for a vertical blind. In an alternate utility the coextruded multilayer slat may be utilized as the color insert for a vertical blind louver which has longitudinally grooved transparent side edges which are adapted to hold a color insert.

23 Claims, 1 Drawing Sheet

VERTICAL COEXTRUDED PEARLESCENT LOUVER FOR VERTICAL BLINDS

BACKGROUND OF THE INVENTION

The present invention relates to window coverings, and in particular, to a coextruded vertical blind louver having at least one pearlescent surface.

Vertical blinds are well known in the field of interior decorating. They are similar to fabric drapes in that they are generally used to cover a window or a sliding glass door. Like fabric drapes, they may be center opening or side opening. The center opening vertical blind opens in the middle of the blind and the two halves withdraw to the two sides of the window to leave a center opening. The side opening vertical blind withdraws from one side to the other side of the window to leave a side opening.

Vertical blinds differ from fabric drapes in that the vertical blind contains a plurality of individual vanes or louvers which are similar to the slats of a venetian blind. However, the venetian blind has slats which are horizontal whereas the vertical blind has vertically suspended slats. Moreover, the vertical blind differs from the fabric drape in that the vertical blind may be at least partially open when, in fact, it remains closed. This is accomplished by a mechanical means whereby the individual vanes or louvers of the vertical blind, which are hanging suspended from overhead, may be turned from a fully open to a fully closed position while the entire blind remains fully extended across the window or door. In addition, the vertical blind may be adjusted so that the individual louvers or vanes are oriented in a position which is intermediate to being turned fully opened or fully closed. In this manner, the vertical blind has a maximum flexibility for keeping sunlight out of the room. For this reason, the vertical blind has gained great popularity at the expense of the conventional fabric drape.

Vertical blinds currently are available with vertical louvers which fall into four major categories. The louvers may be free hanging fabric, fabric supported on a rigid vinyl shell, aluminum or rigid vinyl. Each of these four types of louvers may display different colors and patterns according to the taste of the individual purchaser. It is estimated that rigid vinyl louvers presently account for about 35 percent of all sales of vertical blinds. These louvers are produced from a rigid vinyl containing a pigmentation system which makes the louver highly opaque in order to reduce light transmission.

One type of rigid vinyl vane or louver which is popular is a louver which has side edges which include longitudinal slots or grooves running along the full length of the louver. These slots are open to the center web of the louver and are adapted to receive a color insert. The color insert may be pushed into the slots at one end of the louver and then slid along the louver surface until the color insert covers the full length and width of the louver with a new color or pattern. This allows the vertical blind owner to redecorate at his convenience. The owner can paint his room a new color and then, by use of new inserts, he can change the color of his vertical blind to conform to or contrast with the new color of the room. This grooved louver thus affords the owner maximum flexibility in color coordinating the vertical blind according to his needs or his whim.

Some louvers have side edges which contain grooves on both surfaces of the louver. Such louvers can have a color insert of a first color on one side and a second color on the other side. Thus, the owner of the vertical blind can have one color exposed to the room and the second color exposed to the window and as he may desire. The owner may then adjust the vertical blind to reposition the individual louvers so that the colors are reversed without changing the color inserts.

The grooved louvers described above normally have a central section or base web of a rigid vinyl which is pigmented and opaque to minimize light transmission. The grooved or slotted edges, however, are generally rigid vinyl of a clear and transparent type. This clear and transparent vinyl is used so that the edge portion of the color insert which is held in the slot or groove remains visible to the viewer.

One desirable color characteristic for a vertical blind louver would be to have a pearlescent finish on a rigid vinyl louver. As used herein, the term "pearlescent" is defined as having the sheen and luster of a pearl. In addition to the oyster pearl of jewelry, certain shellfish, such as abalone, have a pearlescent inner surface of the shell. Also, the scales of certain fish, such as herring, are pearlescent. The luster of the classical oyster pearl of jewelry is generally seen as a silverywhite. However, jewelry pearls can have a lustrous cast such as a yellow or a rose tint. In a similar manner, a pearlescent rigid vinyl louver having a color also would be a desirable product.

Many attempts have been made in the past to imitate the light reflective characteristics of the natural pearl. Pearl essences have been originally prepared in the past largely from the scales of certain fishes. Nacreous essences prepared from this natural material are very expensive because of the complicated series of operations which is required in their preparation. The characteristic material of fish scales which imparts a pearly iridescence to plastics is guanine.

In those coating compositions which are designed to imitate the pearl finish, the index of refraction of the pearlescent pigment and the plastic carrier must be different. In the case of guanine, the index of refraction is generally so high relative to the index of refraction of the plastic binder that the material containing guanine is pearlescent to a desirable degree when utilizing a relatively small amount of guanine. More recently, various other materials possessing a flat crystalline lamellar plate-like structure, including mica, have been used with varying degrees of success.

Thus, pearlescent vinyl can currently be manufactured and is commercially available. However, when such pearlescent vinyl products are used in a vertical blind louver, pigmentation systems must be added to increase the opacity to the level necessary for use in a vertical blind. Unfortunately, the addition of the pigmentation system to the pearlescent vinyl covers up the pearlescent pigment, thereby masking and destroying the original pearlescence of the vinyl. Therefore, in order to obtain a pearlescent color effect, one must use a transparent vinyl with a transparent dye, and this fails to provide the opacity which is required so that the vertical blind will not transmit light when the blind is closed and the individual louvers are also oriented in a closed position. Such opacity is necessary in a vertical blind louver in order to provide the privacy which is desired when closing the window covering.

It is, therefore, an object of the present invention to provide an opaque vertical blind louver having a pearlescent luster.

It is also an object of the present invention to provide an opaque vertical blind louver having a colored pearlescent luster.

These and other objects of the invention, as well as the advantages thereof, will become more clear from the disclosure which follows.

SUMMARY OF THE INVENTION

The present invention resides in the recognition that one cannot achieve a pearlescent luster in a vertical blind louver by making the louver slat of a pearlescent vinyl, and in the discovery that an opaque louver can be rendered pearlescent by the application of a very thin surface coating of a clear transparent pearlescent vinyl.

It is believed that the thin coating of a clear transparent pearlescent vinyl provides a multiple reflective coating wherein the light reflective characteristics are enhanced by the fusion interface between the very clear transparent pearlescent vinyl surface coating and the opaque vinyl base of the vertical blind louver. When the vinyl base is the conventional opaque white color, the coated surface acquires a silvery-white pearlescent sheen. When the opaque base contains a pastel pigment or dye, the surface coating acquires a colored pearlescent sheen which corresponds to the colored light which is reflected from the fusion interface at the colored vinyl base of the opaque louver.

Accordingly, therefore, in one broad embodiment the present invention comprehends a multilayer coextruded slat having upper and lower surfaces, first and second side edges, and first and second ends; and having an opaque base layer comprising a first thermoplastic polymer, and a thin transparent pearlescent layer comprising a second thermoplastic polymer upon at least one surface of said opaque base layer.

In a second embodiment the present invention comprehends the foregoing multilayer slat wherein a central layer of a third thermoplastic polymer is confined between the opaque base layer and the pearlescent surface layer. This third polymer will contain a pigment or a dye.

As previously noted, the opaque base layer will conventionally contain a pigment or dye, but in an alternate embodiment it is the transparent pearlescent surface layer which may contain a transparent tinting dye.

An understanding of the present invention may be readily accomplished from the following description which is to be read in light of the accompanying drawings.

DESCRIPTION OF THE PREFERRED EMBODIMENT

Figure 1:
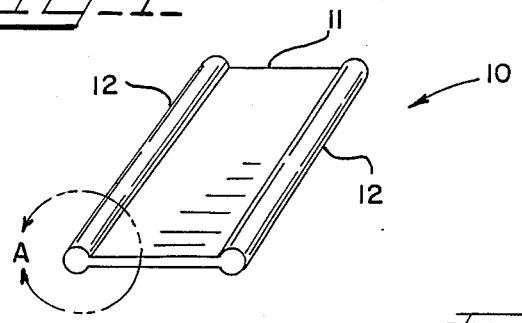
FIG. 1 is a simplified perspective view of a multilayer coextruded slat which is suitable for use as a vertical blind louver, or for use as a color insert for a louver having longitudinally grooved side edges adapted to receive and retain a color insert.

Referring now to FIG. 1, there is shown a multilayer coextruded slat 10 made of a base web or central section 11 having rounded cylindrical side edges 12. Cylindrical side edges 12 may have the general shape of a circular cylinder or an elliptical cylinder, and they eliminate the potential hazard of a sharp edge while providing a structural stiffening effect on the long slat. The multilayer coextruded slat also has an upper and a lower surface, as well as a first and a second end.

Figure 2:
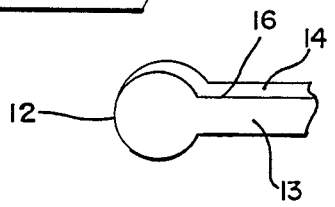
FIG. 2 is an enlarged schematic representation of one corner of the end of the multilayer coextruded slat of FIG. 1, as seen within viewing circle A of FIG. 1, wherein a two layer embodiment of the slat is illustrated.

One corner of the coextruded multilayer slat of FIG. 1 is illustrated by FIG. 2, wherein there is seen the cylindrical side edge 12 of the multilayer coextruded slat. In the embodiment illustrated in FIG. 2, there is seen an opaque base layer 13 having a very thin clear transparent pearlescent surface layer 14 on the upper surface. The base layer 13 and the transparent pearlescent surface layer 14 are integrally merged at a pearlescent fusion interface 16.

Fusion interface 16 is not itself pearlescent, but it provides a surface from which light is reflected. At least a part of the light which is passed through the clear transparent thin pearlescent layer 14 is reflected by the suspended particulate matter within the thin surface layer 14, but another part of the light passes entirely through the pearlescent layer 14 and reaches the fusion interface 16. A portion of the light which is reflected by the suspended particulate matter passes out of layer 14, but another portion is reflected inward to strike the fusion interface 16 at angles which differ from the angle at which the direct light strikes the interface. Thus, the pearlescent fusion interface 16 reflects the light at multiple angles. In addition, the white light or the chromatic light which is reflected from the fusion interface 16 will be additionally reflected in part by the particulate matter which is suspended within the transparent surface layer 14.

It is this multiple reflection of light which finally enters the viewer's eyes at multiple angles which causes the perception of pearlescence. If the opaque base layer 13 is the typical white rigid vinyl, the pearlescent layer will appear pearly white. When the opaque base layer contains a pigment or a dye other than the conventional white pigment, the pearlescent surface layer will reflect a pearlescent color which embodies the reflected chromatic light from the fusion interface 16.

In another embodiment the clear transparent pearlescent surface layer 14 may contain a color effect without reliance upon the color of the opaque base layer. This is achieved by providing a transparent tinting color dye within the pearlescent transparent surface layer 14. The dye may provide a clear color or a translucent color. A translucent color will exist when the dye causes colored light to be transmitted and diffused so that the color of the opaque base layer cannot be perceived. In this embodiment the light which is reflected from the pearlescent fusion interface 16 will only pick up the color of the transparent pearlescent surface layer 14. In addition, light which is reflected at multiple angles by the particulate matter which is suspended within surface layer 14, will only pick up the color of the clear transparent or translucent dye which is contained within the transparent surface layer to thereby give the pearlescent effect.

Figure 3:
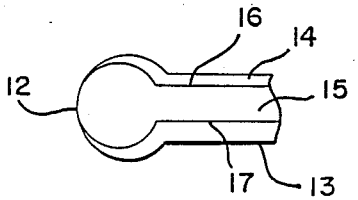
FIG. 3 is an enlarged schematic representation of the same corner of the end of the multilayer coextruded slat of Figure 1, as seen within viewing circle A of FIG. 1, showing the multilayer embodiment to contain three distinct layers.

FIG. 3 illustrates an alternate embodiment of the multilayer coextruded slat of the present invention, wherein there is found three layers. Referring to FIG. 3 there is seen the cylindrical side edge 12 of the coextruded multilayer slat 10. The multilayer slat has the opaque base layer 13 and the transparent pearlescent surface layer 14 with a colored center layer 15 confined in between. The colored central layer 15 may contain a pigment or a dye. The multilayer slat has not only a pearlescent fusion interface 16 but also an opaque fusion interface 17.

In this embodiment the opaque base layer 13 is the conventional vinyl base layer which is white and highly reflective of light, while the pearlescent surface layer 14 is a clear transparent pearlescent vinyl. The pigmented or dyed center layer provides the color for the pearlescent effect. This is a desirable embodiment because the vertical blind can be oriented to present the white opaque side of the louvers towards the exterior of the room, thereby reflecting light and heat from the sun back out through the window or patio door. The pigmented center layer 15 thus is visible to an occupant in the room, and it transmits reflected chromatic light through the clear transparent pearlescent surface layer 14 to provide a tinted pearlescent effect on the inside of the room.

Figure 4:
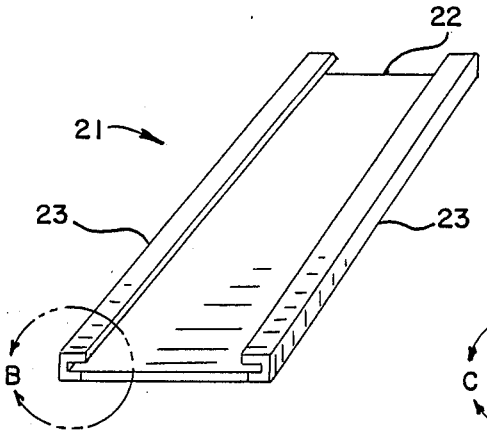
FIG. 4 is a simplified perspective view of a vertical blind louver having single groove side edges adapted to receive and retain a color insert.
Figure 5:
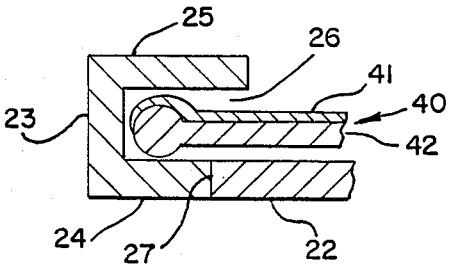
FIG. 5 is an enlarged schematic representation of one corner of the end of the louver of FIG. 4, as seen within viewing circle B of FIG. 4, showing the single groove side edges containing a two-layer coextruded slat.

Referring now to FIGS. 4 and 5 there is shown a louver 21 containing transparent side edges 23 which define a single groove adapted to receive a color insert. Side edges 23 are fused to a pigmented base web or central section 22. As seen more clearly in FIG. 5, side edges 23 include an edge base 24 which is fused and merged with the central section or base web 22 at a fusion interface 27. Also shown in FIG. 5 are the edge finger 25 of the single groove edge 23 which defines a groove or slot 26 which opens toward the louver central section 22 on the upper surface thereof. Contained within the slot 26 there is shown a pearlescent color insert 40 having a thin transparent pearlescent layer 41 on the upper surface of the opaque base layer 42.

Figure 6:
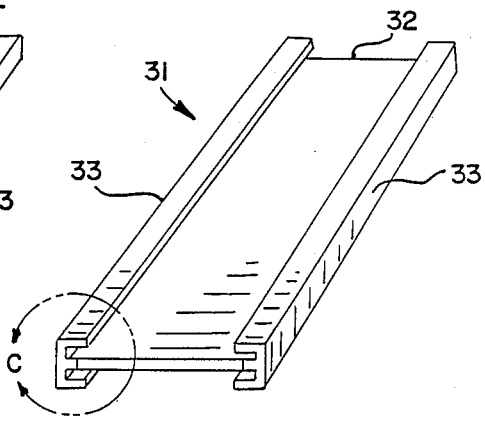
FIG. 6 is a simplified perspective view of a vertical blind louver having longitudinal double groove side edges adapted to receive and retain a pair of color inserts.
Figure 7:
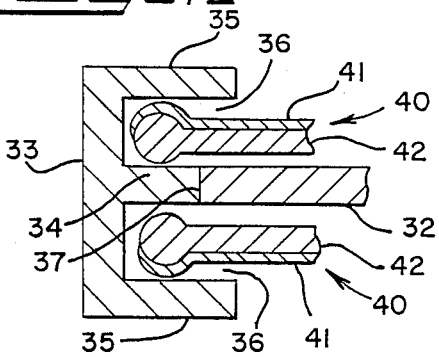
FIG. 7 is an enlarged schematic representation of one corner of the end of the louver of FIG. 6, as seen within viewing circle C of FIG. 6, showing the double groove side edges containing multilayer coextruded slats having two layers.

Referring now to FIGS. 6 and 7 there is shown a slat defining a double grooved louver 31 which is grooved at the upper and the lower surfaces. The louver contains a pigmented central section or base web 32 between transparent double grooved edges 33. As seen more clearly in FIG. 7, the double grooved edges 33 have upper and lower edge fingers 35 which define upper and lower slots 36 between the fingers 35 and the edge base 34. The double grooved edge 33 is fused and integrally held to the pigmented base web 32 at a fusion interface 37. Contained within the upper and lower slots 36 there is shown the pearlescent color inserts 40, having a thin transparent pearlescent layer 41 upon a surface of the opaque base layer 42.

As can be seen in FIG. 7, the upper and lower color inserts are contained within the slots 36 in a manner which provides that the pearlescent outer surface of each color insert is exposed to viewing. That is to say, the lower color insert has the pearlescent surface layer oriented in the downward position while the upper color insert has the pearlescent surface layer oriented in the upward position. It should be noted that, in general, when double groove louvers are used in a louver drape, the pearlescent color inserts will display a different color on each side of the drape.

The method and apparatus configuration for producing the coextruded multilayer slat of the present invention is conventional in the plastic extrusion industry. Multilayer coextrusion dies typically comprise a slot die having internal passages which are configured in a manner sufficient to provide that the individual layers will come together shortly before reaching the die lips under conditions of substantially laminar flow. Since such coextrusion dies are well known in the art and have been in commercial use for a great many years, no description of the slot die utilized to fabricate the multilayer coextruded slat of the present invention is deemed necessary. In addition, it is not deemed necessary to discuss methods of cooling the multilayer extrudate, or of severing and penetrating the cooled extrudate to provide individual slats having end apertures by means of which the slats may be suspended as individual vanes or louvers in a vertical blind. Moreover, those skilled in the art will recognize that the multilayer slat of this invention may be fabricated by a calendering process.

In general, when the multilayer slat of this invention is used as a two layer louver for a vertical blind, the slat may have a nominal width of from about one to five inches, but generally will have a width of about 3.500 inches since this is the most popular size. The slat will also have a center section or central web thickness of from about 0.030 to about 0.035 inch. The thin pearlescent transparent layer will contribute from about 0.005 to about 0.009 inch of this total web thickness in order to achieve good pearlescence. The rounded side edges are formed of a circular cylinder which is an integral outside portion of the opaque base layer, and which has a radius of about 0.025 inch from the centerline of the thickness of the base layer. As seen in FIG. 2, the thin pearlescent layer then coats one surface of the base layer. In an alternate embodiment both surfaces of the opaque base layer may be coated. In any event, the cylindrical edges 12 tend to ultimately have an elliptical cross section rather than a circular cross section.

When the multilayer slat of this invention is used as a three layer louver for a vertical blind, the slat may have a width of from one to five inches, but in general, it will have a width of about 3.500 inches since this is the most popular size. The slat will also have a center section or central web thickness of from about 0.030 to about 0.035 inch. The thin pearlescent transparent layer will contribute from about 0.005 to about 0.009 inch of this total web thickness in order to achieve good pearlescence. The colored center layer and the opaque base layer will each contribute from about 0.010 to about 0.015 inch to this total web thickness. The rounded side edges are formed of a circular cylinder which is an integral outside portion of the colored center layer, and which has a radius of about 0.025 inch from the centerline of the thickness of the colored center layer. As seen in FIG. 3, the thin pearlescent layer then coats one surface of the colored center layer and the opaque base layer covers the other surface so that the cylindrical edges 12 tend to ultimately have an elliptical cross section rather than a circular cross section.

When the multilayer slat of this invention is used as a color insert for sliding into the longitudinal grooves of a verticle blind louver having grooved side edges, the width of the slat may range from about one to five inches, but in general, it will have a width of about 3.500 inches since this is the most popular size. The opaque base layer will have a thickness of about 0.005 inch and the clear transparent pearlescent layer will have a thickness of about 0.007 inch. In general, only the two layer embodiment will be used as a color insert.

The polyvinylchloride which is utilized for the opaque base layer of the multilayer coextruded slat of the present invention is a conventional white rigid vinyl of the type which has been used in extruding vertical blind louvers for a great many years. The polyvinylchloride which is utilized as the central layer in the three layer embodiment is a conventional colored rigid vinyl of the type which has also been used in extruding pigmented louvers for vertical blinds for a great many years. Typical rigid vinyls which are suitable for this service are GEON 87384 and GEON 87320. These two rigid vinyl resins are available from BFGoodrich Company, Chemical Group, Cleveland, Ohio.

The clear transparent pearlescent polyvinylchloride which is utilized in the fabrication of the coextruded multilayer slat of the present invention is a rigid vinyl which contains reflective particulate matter. One such clear transparent pearlescent rigid vinyl which is suitable for this service is GEON 87513-028. This resin is obtained from BFGoodrich Company, Chemical Group, Cleveland, Ohio.

EXAMPLE

An extrusion run was made using a two layer slot die having a slot width designed to produce a pearlescent louver having a width of 3.500 inches. The transparent pearlescent rigid vinyl was GEON 87513-028 and the white opaque resin was GEON 87384. The main extruder melted and pumped the white opaque vinyl at zone temperatures of about 300° F. at a head pressure ranging from 5220 to 5530 psig. The coextruder melted and pumped the pearlescent vinyl at zone temperatures of about 343° F. The extrusion die indicated the white opaque vinyl to be at 307° F. and the pearlescent vinyl to be at 345° F. The two layer extrudate was produced at the rate of 30 feet per minute, and it was cooled, severed and end apertured to produce individual louvers. The louver thickness ranged from 0.030 to 0.035 inch. The thin pearlescent surface layer ranged from 0.005 to 0.009 inch in thickness. The bottom of the louver had a standard white opaque color and the upper surface had a pearlescent silvery-white luster.

In light of the foregoing disclosure, further alternative embodiments of the inventive multilayer coextruded slat, as well as further uses for such a slat, will undoubtedly suggest themselves to those skilled in the art. It is thus intended that the disclosure be taken as illustrative only, and that it not be construed in any limiting sense. Modification and variation may be resorted to without departing from the spirit and the scope of this invention, and such modifications and variations are considered to be within the purview and the scope of the appended claims.

The invention claimed is:

1. A multilayer coextruded slat having upper and lower surfaces, first and second side edges, and first and second ends; having an opaque base layer comprising a first thermoplastic polymer, and a thin transparent pearlescent layer comprising a second thermoplastic polymer upon at least one surface of said opaque base layer; and having a coextruded fusion interface between said opaque base layer and said transparent pearlescent layer.

2. A multilayer coextruded slat according to claim 1 wherein said opaque base layer contains a pigment or a dye.

3. A multilayer coextruded slat according to claim 2 wherein said first thermoplastic polymer comprises an opaque rigid polyvinylchloride and said second thermoplastic polymer comprises a transparent pearlescent rigid polyvinylchloride.

4. A multilayer coextruded slat according to claim 1 wherein said transparent pearlescent surface layer contains a transparent tinting dye.

5. A multilayer coextruded slat according to claim 4 wherein said opaque base layer contains a pigment or a dye.

6. A multilayer coextruded slat according to claim 4 wherein said first thermoplastic polymer comprises an opaque rigid polyvinylchloride and said second thermoplastic polymer comprises a transparent pearlescent rigid polyvinylchloride.

7. A multilayer coextruded slat according to claim 1 wherein said first thermoplastic polymer comprises an opaque rigid polyvinylchloride.

8. A multilayer coextruded slat according to claim 1 wherein said second thermoplastic polymer comprises a transparent pearlescent rigid polyvinylchloride.

9. A multilayer coextruded slat according to claim 1 wherein said slat has a total thickness of from about 0.030 to about 0.035 inch and said transparent pearlescent layer has a thickness of from about 0.005 to about 0.009 inch.

10. A multilayer coextruded slat according to claim 1 wherein said opaque base layer has a thickness of about 0.005 inch and said transparent pearlescent layer has a thickness of about 0.007 inch.

11. A multilayer coextruded slat according to claim 1 wherein said slat comprises a pearlescent layer having a thickness of about 0.005 inch.

12. A multilayer coextruded slat according to claim 1 wherein said pearlescent layer has a thickness of from about 0.005 inch to about 0.009 inch.

13. A multilayer coextruded slat having upper and lower surfaces, first and second side edges, and first and second ends; having an opaque base layer comprising a first thermoplastic polymer, a thin transparent pearlescent layer comprising a second thermoplastic polymer, and a central layer comprising a third thermoplastic polymer confined between said opaque base layer and said pearlescent layer; having a first coextruded fusion interface between said central layer and said opaque base layer; and having a second coextruded fusion interface between said central layer and said pearlescent layer.

14. A multilayer coextruded slat according to claim 13 wherein said opaque base layer contains a pigment or a dye.

15. A multilayer coextruded slat according to claim 13 wherein said transparent pearlescent layer contains a transparent tinting dye.

16. A multilayer coextruded slat according to claim 13 wherein said first thermoplastic polymer comprises an opaque rigid polyvinylchloride.

17. A multilayer coextruded slat according to claim 13 wherein said second thermoplastic polymer comprises a transparent pearlescent rigid polyvinylchloride.

18. A multilayer coextruded slat according to claim 13 wherein said third thermoplastic polymer comprises a colored rigid polyvinylchloride.

19. A multilayer coextruded slat according to claim 13 wherein said slat has a total thickness of from about 0.030 to about 0.035 inch, said transparent pearlescent layer has a thickness of from about 0.005 to about 0.009 inch, said opaque base layer has a thickness of from about 0.010 to about 0.015 inch, and said center layer has a thickness of from about 0.010 to about 0.015.

20. A multilayer coextruded slat according to claim 13 wherein said pearlescent layer has a thickness of about 0.005 inch.

21. A multilayer coextruded slat according to claim 13 wherein said pearlescent layer has a thickness of from about 0.005 inch to about 0.009 inch.

22. A multilayer coextruded slat according to claim 13 wherein said central layer contains a pigment or a dye.

23. A multilayer coextruded slat according to claim 13 wherein said first thermoplastic polymer comprises an opaque rigid polyvinylchloride, said second thermoplastic polymer comprises a transparent pearlescent rigid polyvinylchloride, and said third thermoplastic polymer comprises a colored rigid polyvinylchloride.

* * * * *

REEXAMINATION CERTIFICATE (1523rd)

United States Patent [19] [11] B1 4,877,077

Ebert [45] Certificate Issued Jul. 30, 1991

[54] VERTICAL COEXTRUDED PEARLESCENT LOUVER FOR VERTICAL BLINDS

[75] Inventor: George W. Ebert, Chatsworth, Calif.

[73] Assignee: Home Fashions, Inc.

Reexamination Request:
No. 90/002,031, May 14, 1990

Reexamination Certificate for:

| | |
|---|---|
| Patent No.: | **4,877,077** |
| Issued: | **Oct. 31, 1989** |
| Appl. No.: | **193,806** |
| Filed: | **May 13, 1988** |

[51] Int. Cl.[5] ..... E06B 3/04; B32B 5/16
[52] U.S. Cl. ..... 160/236; 428/324
[58] Field of Search ..... 160/236; 428/522, 324

[56] References Cited

U.S. PATENT DOCUMENTS

| | | | |
|---|---|---|---|
| 2,555,224 | 5/1951 | Decker | 106/287 |
| 2,851,370 | 9/1958 | Blank | 106/193 |
| 3,125,484 | 3/1964 | Weiss . | |
| 3,379,674 | 4/1968 | Jakob et al. | 260/41 |
| 3,592,882 | 7/1971 | Morita . | |
| 3,645,317 | 2/1972 | Malone | 160/168 |
| 3,769,380 | 10/1973 | Wiley . | |
| 4,195,680 | 4/1980 | Hyman et al. . | |
| 4,416,940 | 11/1983 | Loye et al. | 428/324 |
| 4,457,961 | 7/1984 | Nakazawa et al. . | |
| 4,551,491 | 11/1985 | Panush | 524/31 |

*Primary Examiner*—Blair M. Johnson

[57] ABSTRACT

A multilayer coextruded slat having upper and lower surfaces has an opaque base layer containing a first thermoplastic polymer, and a thin transparent pearlescent layer containing a a second thermoplastic polymer upon at least one surface of the opaque base layer. In an alternate embodiment a center layer is confined between the opaque base layer and the clear transparent pearlescent surface layer to provide a pearlescent color effect. Such multilayer coextruded slats may be utilized as the louvers for a vertical blind. In an alternate utility the coextruded multilayer slat may be utilized as the color insert for a vertical blind louver which has longitudinally grooved transparent side edges which are adapted to hold a color insert.

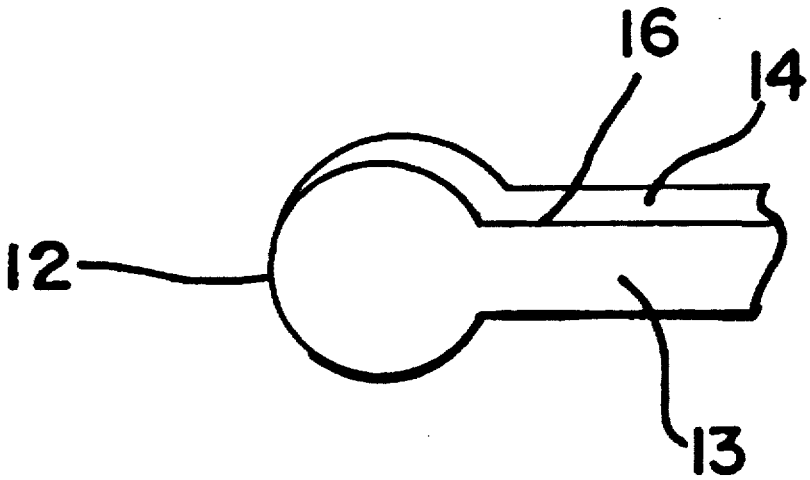

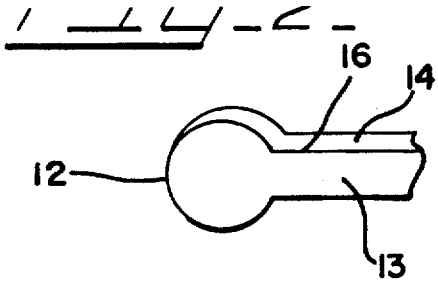
16
14
12
13

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 13 are determined to be patentable as amended.

Claims 2-12 and 14—23, dependent on an amended claim, are determined to be patentable.

New claims 24-35 are added and determined to be patentable.

1. A multilayer, *rigid* coextruded slat *for a window-covering blind* having *a length greatly exceeding its width, and further having* upper and lower surfaces, first and second side edges, and first and second ends; having an opaque base layer comprising a first thermoplastic polymer, and a thin transparent pearlescent layer comprising a second thermoplastic polymer upon at least one surface of said opaque base layer; and having a coextruded fusion interface between said opaque base layer and said transparent pearlescent layer.

13. A multilayer, *rigid* coextruded slat *for a window-covering blind* having *a length greatly exceeding its width, and further having* upper and lower surfaces, first and second side edges, and first and second ends; having an opaque base layer comprising a first thermoplastic polymer, and a thin transparent pearlescent layer comprising a second thermoplastic polymer, and a central layer comprising a third thermoplastic polymer confined between said opaque base layer and said pearlescent layer, having a coextruded fusion interface between said central layer and said opaque base layer; and having a second coextruded fusion interface between said central and said pearlescent layer.

*24. In a window-covering blind having rigid louvers, said louvers comprising multilayer coextruded rigid slats, said slats having a length greatly exceeding their width, and further having upper and lower surfaces, first and second side edges, and first and second ends; each of said slats having an opaque base layer comprising a first thermoplastic polymer, and a thin transparent pearlescent layer comprising a second thermoplastic polymer upon at least one surface of said opaque base layer; and having a coextruded fusion interface between said opaque base layer and said transparent pearlescent layer.*

*25. A window-covering blind according to claim 24, wherein said opaque base layer contains a pigment or a dye.*

*26. A window-covering blind according to claim 25, wherein said first thermoplastic polymer comprises an opaque rigid polyvinylchloride and said second thermoplastic polymer comprises a transparent pearlescent rigid polyvinylchloride.*

*27. A window-covering blind according to claim 24 wherein said transparent pearlescent surface layer contains a transparent tinting dye.*

*28. A window-covering blind according to claim 27 wherein said opaque base layer contains a pigment or a dye.*

*29. A window-covering blind according to claim 27 wherein said first thermoplastic polymer comprises an opaque rigid polyvinylchloride and said second thermoplastic polymer comprises a transparent pearlescent rigid polyvinylchloride.*

*30. A window-covering blind according to claim 24 wherein said first thermoplastic polymer comprises an opaque rigid polyvinylchloride.*

*31. A window-covering blind according to claim 24 wherein said second thermoplastic polymer comprises a transparent pearlescent rigid polyvinylchloride.*

*32. A window-covering blind according to claim 24 wherein said slat has a total thickness of from about 0.030 to about 0.035 inch and said transparent pearlescent layer has a thickness of from about 0.005 to about 0.009 inch.*

*33. A window-covering blind according to claim 24 wherein said opaque base layer has a thickness of about 0.005 inch and said transparent pearlescent layer has a thickness of about 0.007 inch.*

*34. A window-covering blind according to claim 24 wherein said slat comprises a pearlescent layer having a thickness of about 0.005 inch.*

*35. A window-covering blind according to claim 24 wherein said pearlescent layer has a thickness of from about 0.005 inch to about 0.009 inch.*

* * * * *